US008097102B2

(12) United States Patent
Gao et al.

(10) Patent No.: US 8,097,102 B2
(45) **Date of Patent: *Jan. 17, 2012**

(54) CU-TI-BASED COPPER ALLOY SHEET MATERIAL AND METHOD OF MANUFACTURING SAME

(75) Inventors: Weilin Gao, Iwata (JP); Hisashi Suda, Iwata (JP); Hiroto Narieda, Hamamatsu (JP); Akira Sugawara, Iwata (JP)

(73) Assignee: Dowa Metaltech Co., Ltd., Tokyo (JP)

( * ) Notice: Subject to any disclaimer, the term of this patent is extended or adjusted under 35 U.S.C. 154(b) by 519 days.

This patent is subject to a terminal disclaimer.

(21) Appl. No.: 12/314,281

(22) Filed: Dec. 8, 2008

(65) Prior Publication Data

US 2010/0139822 A1 Jun. 10, 2010

(51) Int. Cl.
*C22F 1/08* (2006.01)
*C22C 9/00* (2006.01)

(52) U.S. Cl. ..... 148/682; 148/411; 148/554

(58) Field of Classification Search ..... 148/682, 148/411, 554

See application file for complete search history.

(56) References Cited

U.S. PATENT DOCUMENTS 2,943,960 A * 7/1960 Saarivirta ..... 148/554
4,599,119 A * 7/1986 Ikushima et al. ..... 148/411

FOREIGN PATENT DOCUMENTS

JP 2006-241573 9/2006
JP 2006-249565 9/2006
JP 2006-265611 10/2006
JP 2006-274289 10/2006

* cited by examiner

*Primary Examiner* — Roy King
*Assistant Examiner* — Jessee R. Roe
(74) *Attorney, Agent, or Firm* — Clark & Brody

(57) ABSTRACT

Provided is a Cu—Ti-based copper alloy sheet material that satisfies all the requirements of high strength, excellent bending workability and stress relaxation resistance and has excellent sprig-back resistance. The copper alloy sheet material has a composition containing, by mass, from 1.0 to 5.0% of Ti, and optionally containing at least one of at most 0.5% of Fe, at most 1.0% of Co and at most 1.5% of Ni, and further optionally containing at least one of Sn, Zn, Mg, Zr, Al, Si, P, B, Cr, Mn and V in an amount within a suitable range, with the balance of Cu and inevitable impurities, and having a crystal orientation satisfying the following expression (1) and preferably also satisfying the following expression (2). The mean crystal grain size of the material is controlled to be from 10 to 60 μm.

$$I\{420\}/I_0\{420\}>1.0 \quad (1)$$

$$I\{220\}/I_0\{220\}\leqq 3.0 \quad (2)$$

9 Claims, 2 Drawing Sheets

CU-TI-BASED COPPER ALLOY SHEET MATERIAL AND METHOD OF MANUFACTURING SAME

BACKGROUND OF THE INVENTION

1. Field of the Invention

This invention relates to a Cu—Ti-based copper alloy sheet material suitable for use in electrical and electronic parts such as connectors, lead frames, relays, switches and the like, particularly to the copper alloy sheet material that exhibits excellent bending workability and stress relaxation resistance while maintaining high strength, and to a method of producing the same.

2. Background Art

Materials for use for components such as connectors, lead frames, relays, switches and the like that constitute electrical and electronic parts require high "strength" capable of enduring stress imparted during assembly and/or operation of the electrical or electronic parts. Because electrical and electronic parts are generally formed by bending, they also require excellent "bending workability". Moreover, in order to ensure contact reliability between electrical and electronic parts, they require endurance against the tendency for contact pressure to decline over time (stress relaxation), namely, they need to be excellent in "stress relaxation resistance".

Of particular note is that as electrical and electronic parts have become more densely integrated, smaller and lighter in weight in recent years, demand has increased for thinner copper and copper alloy materials for use in the parts. This in turn has led to still severer requirements for the level of "strength" of materials. To be more specific, a strength level expressed as tensile strength of 800 MPa or greater, preferably 900 MPa or greater, even more preferably 1000 MPa or greater, is desired.

Further, the emergence of smaller and more complexly shaped electrical and electronic parts has created a strong need for improved shape and dimensional accuracy in components fabricated by bending. The importance in the requirement for "bending workability" includes not only the absence of cracks in the bent areas but also ensured shape and dimensional accuracy of the articles worked by bending. A troublesome problem occurring more or less in bending is spring-back. Spring-back is a phenomenon of elastic deformation recovery of a worked article taken out of a mold, which means that the shape of the article taken out of a mold differs from that of the article just after worked in the mold.

With the increase in the requirement for the strength level of materials to a further higher degree, the problem of spring-back tends to increase. For example, in fabricating connector terminals having a box-like bent shape, the shape and the dimension of the terminals may be out of order owing to spring-back, and they may be after all useless. Recently, therefore, increased use is being made of a bending method in which the starting material is notched at the location to be bent and bending is later carried out along the notch (hereinafter referred to as "notch-and-bend method"). With this method, however, the notching work hardens the vicinity of the notch, so that cracking is apt to occur during the ensuing bending. The "notch-and-bend method" can therefore be viewed as a very harsh bending method from the viewpoint of the material.

In addition, the fact that more and more electrical and electronic parts are being utilized in severe environment applications has made "stress relaxation resistance" as an increasingly critical issue. For example, "stress relaxation resistance" is of particular importance when the part is exposed to a high-temperature environment as in the case of an automobile connector Stress relaxation refers to the phenomenon of, for instance, a spring member constituting an element of an electrical or electronic part experiencing a decline in contact pressure with passage of time in a relatively high-temperature environment (e.g., 100 to 200° C.), even though it might maintain a constant contact pressure at normal temperatures. It is thus one kind of creep phenomenon. To put it in another way, it is the phenomenon of stress imparted to a metal material being relaxed by plastic deformation owing to dislocation movement caused by self-diffusion of atoms constituting the matrix and/or diffusion of solute atoms.

But there are tradeoffs between "strength" and "bending workability", or between "bending workability" and "stress relaxation resistance". Up to now, the practice regarding such current-carrying components has been to take the purpose of use into account in suitably selecting a material with optimum "strength", "bending workability" or "stress relaxation resistance".

A Cu—Ti-based copper alloy has high strength next to a Cu—Be-based alloy of copper alloys, and has stress relaxation resistance over a Cu—Be-based alloy. From the viewpoint of the cost and the load to the environment thereof, a Cu—Ti-based alloy is superior to a Cu—Be-based alloy. Accordingly, a Cu—Ti-based copper alloy is used for a connector material as a substitute for a Cu—Be-based alloy. However, it is generally known that, like a Cu—Be-based alloy, a Cu—Ti-based alloy is an alloy system capable of hardly satisfying both "strength" and "bending workability".

Accordingly, in many cases, a Cu—Ti-based alloy sheet material is shipped while it is still relatively soft before aging treatment, and then, after shaped by bending and/or pressing, it is hardened by aging treatment. However, the method of aging treatment after bending and/or pressing is disadvantageous for producibility improvement and cost reduction since the worked alloy may be discolored owing to oil adhesion thereto and since the method requires an exclusive furnace for heat treatment. Accordingly, of Cu—Ti-based copper alloy sheet materials, market needs are increasing these days for sub-aged materials (mill-hardened materials) that do not require aging treatment after bending and/or pressing. Mill-hardened materials are sheet materials that have been aged to a level not reaching the maximum hardness thereof. The advantage of using them is that the aging treatment after working into parts may be omitted in many applications not requiring the maximum strength level. However, though relatively light, it cannot be denied that the sub-aging treatment may worsen the workability of the materials.

In general, refinement of crystal grain size effectively improves "bending workability", and the same shall apply to a Cu—Ti-based copper alloy. However, the crystal grain boundary area per unit volume increases with decreasing the crystal grain size. Accordingly, crystal grain refinement promotes stress relaxation, which is a type of creep phenomenon. In relatively high-temperature environment applications, the diffusion velocity of the atom along grain boundaries is extremely higher than that inside the grains, so that the loss of "stress relaxation resistance" caused by crystal grain refinement becomes a major problem.

Further, in a Cu—Ti-based copper alloy, "precipitates" exist essentially as an intragranular modulated structure (spinodal structure), and there are a relatively few "precipitates" to be the second phase grains acting for pinning the growth of recrystallized grains; and during the step of treatment for solid solution formation, it is not easy to attain crystal grain refinement.

In recent years, crystal grain refinement and control of crystal orientation (texture) have been proposed for improving the properties of Cu—Ti-based alloys (see Patent References 1 to 4).

Patent Reference 1: JP-A 2006-265611
Patent Reference 2: JP-A 2006-241573
Patent Reference 3: JP-A 2006-274289
Patent Reference 4: JP-A 2006-249565

It is well known that crystal grain refinement and control of crystal orientation (texture) are effective for improving the bending workability of copper alloy sheet materials. Regarding control of the crystal orientation (texture) of a Cu—Ti-based copper alloy, in the case where ordinary production processes are utilized, the X-ray diffraction pattern from the sheet surface (rolled surface) is generally dominated by the diffraction peaks from the four crystal planes {111}, {200}, {220} and {311}, and the X-ray diffraction intensities from the other crystal planes are very weak compared with those from these four planes. The diffraction intensities from the {200} plane and the {311} plane are usually large after solution heat treatment (recrystallization). The ensuing cold rolling lowers the diffraction intensities from these planes, and the X-ray diffraction intensity from the {220} plane increases relatively. The X-ray diffraction intensity from the {111} plane is usually not much changed by the cold rolling.

In Patent Reference 1, the cold rolling ratio before solution heat treatment is defined to be at least 89% for crystal grain refinement. The strain introduced at such a high rolling reduction ratio functions as a nucleus for recrystallization, thereby giving fine crystal grains having a grain size of from 2 to 10 μm or so. However, the crystal grain refinement of the type is often accompanied by reduction in "stress relaxation resistance". In addition, since the hot-rolling temperature is 850° C. and is high, the technique of this reference could not sufficiently improve the bending workability of the alloy, as so confirmed by the present inventors' investigations.

Patent Reference 2 defines the X-ray diffraction intensity ratio from {220} and {111}, as I{220}/I{111}>4, for improving the strength and the conductivity of the alloy. This kind of texture regulation to define the {220} plane as the main orientation component may be effective for improving the strength and the conductivity of the alloy, but lowers the bending workability thereof, as so confirmed by the present inventors' investigations. In fact, Patent Reference 2 is silent on the bending workability of the alloy.

Patent Reference 3 proposes a texture of an alloy having improved bending workability of such that, in the {111} pole figure thereof, the maximum value of the X-ray diffraction intensities within the four regions including {110}<115>, {110}<114> and {110}<113> is from 5.0 to 15.0 (in terms of the ratio to the random orientation). For obtaining the texture of the type, the cold-rolling reduction ratio before the solution heat treatment is defined to be from 85 to 97%. The texture of the type is a typical alloy-rolled texture ({110}<112> to {110}<100>), and its {111} pole figure is similar to the {111} pole figure of 70/30 brass (for example, see "Metal Data Book", 3 Rev. Ed., p. 361). According to the conventional method of controlling the crystal orientation distribution on the basis of the alloy texture, it is difficult to significantly improve the bending workability of alloy. In fact, the bending workability in Patent Reference 3, R/t is at most 1.6.

Patent Reference 4 proposes an alloy texture satisfying I{311}/I{111}≧0.5. However, the present inventors' investigations confirmed that it is difficult to stably and remarkably improve the bending workability of the alloy of the type.

Use of the above-mentioned notch-and-bend method on a copper alloy sheet material effectively improves the shape and dimensional accuracy of the bent article. However, in the Cu—Ti-based alloys having the controlled texture as in Patent References 1 to 4, no consideration is given to preventing cracking caused by the notch-and-bend method. The present inventors' investigations confirmed that the bending workability after notching of the alloys is not sufficiently improved.

Cu—Ti-based alloy sheet materials are often supplied as mill-hardened materials, but the mill-hardened materials are problematic in that the bent articles thereof could hardly maintain the shape and dimensional accuracy because of spring-back. For spring-back reduction, the above-mentioned "notch-and-bend method" may be effective, but in the working method, the area around the notched part is work-hardened owing to notching, and therefore it may be readily cracked during the ensuing bending. At present, the "notch-and-bend method" is not as yet industrially employed for mill-hardened materials of Cu—Ti-base alloys.

Further, as so mentioned in the above, crystal grain refining may be effective in some degree for improvement of bending workability, but on the contrary, it is a negative factor in overcoming stress relaxation, a type of creep phenomenon. From these, only for the "bending workability", its high-level improvement is difficult in the current situation, and further improvement of "stress relaxation resistance" could not be realized even though known texture control techniques are utilized.

SUMMARY OF THE INVENTION

Given that situation, the present invention is to provide a Cu—Ti-based copper alloy sheet material capable of enhancing both severe "bending workability" required in "notch-and-bend method" and "stress relaxation resistance" that ensures reliability in severe service conditions for vehicle-mounted connectors and the like, and capable of reducing "spring-back", while maintaining "high strength".

Through an in-depth study, the inventors have discovered that there exists a crystal orientation with an orientation relationship such that deformation easily occurs in a direction normal to the surface of a rolled sheet (ND) and also occurs easily in two mutually perpendicular directions in the sheet surface. In addition, the inventors have determined an alloy composition range and production conditions enabling establishment of a texture composed mainly of crystal grains having this unique orientation relationship. The present invention has been accomplished base on these findings.

Specifically, the invention provides a copper alloy sheet material containing, by mass, from 1.0 to 5.0% of Ti and optionally containing at least one of at most 0.5% of Fe, at most 1.0% of Co and at most 1.5% of Ni, with the balance of Cu and inevitable impurities, and having a crystal orientation satisfying the following expression (1) and preferably also satisfying the following expression (2). The mean crystal grain size of the material is controlled to be from 10 to 60 μm, preferably from more than 10 to 60 μm.

$$I\{420\}/I_0\{420\}>1.0 \quad (1)$$

$$I\{220\}/I_0\{220\}\leqq 3.0 \quad (2)$$

In these expressions, I{420} is the X-ray diffraction integral intensity from the {420} crystal plane of the copper alloy sheet material, and $I_0\{420\}$ is the X-ray diffraction integral intensity from the {420} crystal plane of a standard pure copper powder. Similarly, I{220} is the X-ray diffraction integral intensity from the {220} crystal plane of the copper alloy sheet material, and $I_0\{220\}$ is the X-ray diffraction integral intensity from the {220} crystal plane of a standard pure copper powder. I{420} and $I_0${420} are measured under the same conditions and so are I{220} and $I_0${220} The mean crystal grain size is determined by the cutting method of JIS H0501, specifically by polishing and then etching the sheet surface (rolled sheet surface) and observing the surface with a microscope.

The invention further provides a copper alloy sheet material having a composition containing, in addition to the above ingredients, at least one additional ingredient of at most 1.2% of Sn, at most 2.0% of Zn, at most 1.0% of Mg, at most 1.0% of Zr, at most 1.0% of Al, at most 1.0% of Si, at most 0.1% of P, at most 0.05% of B, at most 1.0% of Cr, at most 1.0% of Mn and at most 1.0% of V, in an amount of at most 3% by mass in total.

Of the above-mentioned copper alloy sheet material, one preferred embodiment satisfies the bending workability of such that the tensile strength thereof in LD (rolling direction) is at least 800 MPa, the ratio R/t is at most 1.0 in both LD and TD (direction perpendicular to the rolling direction and to the sheet thickness direction) where R indicates the minimum bending radius of the sheet material not cracking in the 90°-W bending test of JIS H3110 and t indicates the sheet thickness t thereof, and the value θ-90° indicating the spring-back of the sheet material is at most 3° in both LD and TD where θ (t) indicates the actual bending deformation angle of the bend (the center of three) of the bending test piece of the sheet material giving the value R/t. In this description, the bending workability confirmed in the 90°-W bending test of JIS H3110 is referred to as "ordinary bending workability", and is differentiated from the "bending workability after notching" to be described hereinunder.

A method of producing the above-mentioned copper alloy sheet is provided, which comprises steps of hot rolling at 950 to 500° C., cold rolling at a reduction ratio of at least 80%, solution heat treatment at 700 to 900° C., finish cold rolling at a reduction ratio of from 0 to 65% and aging treatment at 300 to 550° C. in that order, wherein in the hot rolling step, the first rolling pass is effected in a temperature range of from 950° C. to 700° C., then the rolling is effected in a temperature range of from lower than 700° C. to 500° C. at a reduction ratio of at least 30%. Preferably in the hot-rolling step, the reduction ratio is at least 60% in a temperature range of from 950° C. to 700° C. Preferably in the solution heat treatment step, the retention time in a range of from 700 to 850° C. and the ultimate temperature are so set in the heat treatment that the mean crystal grain size after the solution heat treatment is from 10 to 60 μm, more preferably from more than 10 to 60 μm.

"Reduction ratio of 0%" in the finish cold rolling means the absence of the rolling. In other words, the cold rolling may be omitted. The reduction ratio ϵ (%) at a given temperature range is defined by the following expression (3):

$$\epsilon=(t_0-t_1)/t_0\times 100 \quad (3)$$

where $t_0$ (mm) means the sheet thickness before the first rolling pass of the continuous rolling passes to be effected in the temperature range, and $t_1$ (mm) is the sheet thickness after the final rolling pass of the rolling passes.

A condition for the aging treatment step is employable, wherein the aging temperature is within a range of from 300 to 550° C. and is a temperature of $T_M$±10° C. and the aging time is so defined that the hardness after the aging falls within a range of from 0.85 $H_M$ to 0.95 $H_M$ and wherein $T_M$ (° C.) means the aging temperature at which the maximum hardness can be obtained with the composition and $H_M$ (HV) means the maximum hardness.

The invention provides a Cu—Ti-based copper alloy sheet material having the basic properties required by connectors, lead frames, relays, switches and other electrical and electronic parts, namely, such a Cu—Ti-based copper alloy sheet material of high strength having a tensile strength of at least 800 MPa and even at least 900 MPa, and having excellent workability (especially bending workability) and stress relaxation resistance. According to conventional Cu—Ti-based copper alloy production techniques, it is difficult to stably and remarkably enhance the bending workability and stress relaxation resistance of those copper alloy sheet materials while making them still keep such high-level strength. In addition, in the invention, "spring-back" in working the alloy sheet material is significantly reduced. Accordingly, the invention facilitates the improvement in the dimensional accuracy in working the Cu—Ti-based copper alloy sheet material into industrial parts. The invention provides a solution in response to the trend toward smaller and thinner electrical and electronic parts, which is expected to accelerate even further in the future.

DESCRIPTION OF THE PREFERRED EMBODIMENTS

In the invention, the texture of the copper alloy sheet material is controlled to have a specific crystal orientation, thereby improving the "strength", "bending workability" and "stress relaxation resistance" of the alloy sheet and reducing the "spring-back" thereof. The specific matters of the invention are described below.

<<Texture>>

The X-ray diffraction pattern from a Cu—Ti-based copper alloy sheet surface (rolled surface) generally includes diffraction peaks from the four crystal planes {111}, {200}, {220} and {311}, and the X-ray diffraction intensities from the other crystal planes are very weak compared with those from these four planes. In a Cu—Ti-based copper alloy sheet obtained in an ordinary production process, the diffraction intensity from the {420} plane is so weak as to be negligible. However, the present inventors' detailed investigations have revealed that a Cu—Ti-based copper alloy sheet material having a texture of which the main orientation component is the {420} plane is obtained according to the production condition described hereinunder. The inventors have further found that the stronger the development of this texture becomes, the more advantageous it is for improvement of bending workability. The mechanism of the bending workability improvement is at present believed to be as follows.

The Schmid factor is an index of easiness of plastic deformation (slip) when an external force acts on a crystal in a certain direction. Where the angle between the direction of force application to the crystal and the normal to the slip surface is represented by ϕ and the angle between the direction of force application to the crystal and the slip direction is represented by λ, then the Schmid factor is represented by cos $\phi \cdot \cos \lambda$ and the value thereof falls in a range of not more than 0.5. A larger Schmid factor (that is, nearer to 0.5) means a larger shear stress in the slip direction. From this, it follows that when an external force is applied to a crystal in a certain direction, then the easiness of crystal deformation increases with increasing the magnitude of the Schmid factor (that is, increasing nearer to 0.5). The crystal structure of the Cu—Ti-based copper alloy is a face-centered cubic (fcc) system. In the slip system of a face-centered cubic crystal, the slip plane is {111} and the slip direction is <110>, and it is known that in actual crystals, deformation more readily occurs and work-hardening decreases in proportion to the Schmid factor increase.

Figure 1:
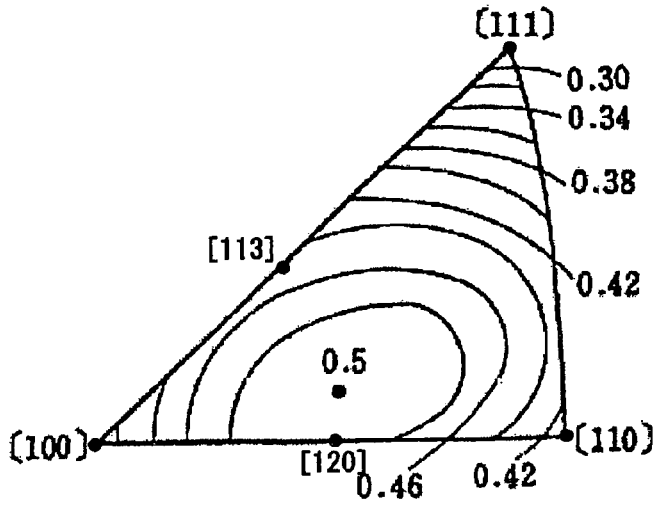
FIG. 1 is a standard inverse pole figure showing the Schmid factor distribution of a face-centered cubic crystal.

FIG. 1 is a standard inverse pole figure showing the Schmid factor distribution of a face-centered cubic crystal. The Schmid factor in the <120> direction is 0.490, which is close to 0.5. In other words, when an external force is applied in the <120> direction, then the face-centered cubic crystal deforms very easily. The Schmid factors in the other directions are: <100> direction, 0.408; <113> direction, 0.445; <110> direction, 0.408; <112> direction, 0.408; and <111> direction, 0.272.

To say that a texture's main orientation component is the {420} plane means that the proportion of crystals of which the {420} plane (and {210} plane) lie substantially parallel to the sheet surface (rolled surface) is high. In a crystal of which the main orientation plane is the {210} plane, the direction normal to the sheet surface (ND) is the <120> direction and its Schmid factor is near to 0.5, so that it readily deforms in ND and the work-hardening thereof is low. On the other hand, the rolled texture of the Cu—Ti-based alloy ordinarily has the {220} plane as its main orientation component. In this case, the proportion of crystals of which the {220} plane (and {110} plane) lie substantially parallel to the sheet surface (rolled surface) is high. In a crystal of which the main orientation plane is the {110} plane, ND thereof is the <110> direction and the Schmid factor thereof is about 0.4, so that work-hardening upon deformation in ND is large as compared with that in the case of a crystal of which the main orientation plane is the {210} plane. The recrystallized texture of the Cu—Ti-based alloy ordinarily has the {311} plane as its main orientation component. In a crystal of which the main orientation plane is the {311} plane, ND thereof is the <113> direction and the Schmid factor thereof is about 0.45, so that work-hardening upon deformation in ND is also large as compared with that in the case of a crystal of which the main orientation plane is the {210} plane.

In "notch-and-bend method", the degree of work-hardening at the time of deformation in the direction normal to the sheet surface (ND) is very important. This is because the notching is indeed the deformation in ND, and the degree of work-hardening at the portion reduced in thickness by the notching strongly governs the bending workability during subsequent bending along the notch. In the case of the texture that satisfies the expression (1) to have the {420} plane as its main orientation component, work-hardening caused by notching becomes small in comparison with that in the case of the rolled texture or recrystallized texture of a conventional Cu—Ti-based alloy. This is considered to be the reason for the marked improvement in bending workability in the notch-and-bend method.

Moreover, in the case of the texture that satisfies the expression (1) to have the {420} plane as its main orientation component, the <120> direction and the <100> direction are present as other directions in the sheet plane, i.e., in the {210} plane, in the crystal of which the main orientation plane is the {210} plane, and these directions are mutually perpendicular to each other. In fact, it has been ascertained that the rolling direction (LD) is the <100> direction and the direction perpendicular to the rolling direction (TD) is the <120> direction. To illustrate this using specific crystal directions, in a crystal of which the main orientation plane is the <120> plane, for example, LD thereof is the [001] direction and TD thereof is the [−2,1,0] direction. The Schmid factors of such a crystal are LD: 0.408 and TD: 0.490. In contrast, in the case of the ordinary rolled texture of the Cu—Ti-based alloy having the {110} plane as its main orientation plane, LD thereof is the <112> direction and TD thereof is the <111> direction, and the in-plane Schmid factors thereof are LD: 0.408 and TD: 0.272. In the case of the ordinary recrystallized texture of the Cu—Ti-based alloy having the {113} plane as its main orientation plane, LD thereof is the <112> direction and TD thereof is the <110> direction, and the in-plane Schmid factors thereof are LD: 0.408 and TD: 0.408. Thus, considering the Schmid factors in LD and TD, it can be said that when the texture has the {420} plane as its main orientation component, then deformation in the sheet surface is easier than in the cases of the rolled texture and recrystallized texture of a conventional Cu—Ti-based alloy. This is also thought to work favorably toward preventing cracking during bending after notching.

When a metal sheet is bent, the constitutive crystal grains therein do not deform uniformly since they differ in the crystal orientation. A metal sheet generally has crystal grains that may easily deform when bent and those that may hardly deform. With the increase in the degree of bending, easily deformable crystal grains deform more predominantly with the result that microscopic projections and recesses form in the bent area of the sheet owing to the ununiform deformation of the constitutive crystal grains, thereby producing wrinkles to often cause cracks (rupture). In the metal sheet having the texture that satisfies the expression (1), the constitutive crystal grains readily deform in ND, as compared with those of conventional ones, and the metal sheet may readily deform inside it. This is thought to be why the metal sheet of the type may be markedly improved in point of the bending workability after notching and in the ordinary bending workability thereof even though the constitutive crystal grains are not specifically processed for crystal grain refinement.

The present inventors' investigations have revealed that the crystal orientation can be defined by the following expression (1)

$$I\{420\}/I_0\{420\}>1.0 \quad (1)$$

In this, I{420} is the X-ray diffraction integral intensity from the {420} crystal plane of the copper alloy sheet material, and $I_0\{420\}$ is the X-ray diffraction integral intensity from the {420} crystal plane of a standard pure copper powder. In the X-ray diffraction pattern of a face-centered cubic crystal, reflection from the {420} plane is observed but no reflection from the {210} plane is observed, so the crystal orientation of the {210} is judged from the {420} plane reflection. More preferably, the crystal orientation satisfies the following expression (1)':

$$I\{420\}/I_0\{420\}>1.5 \quad (1)'$$

The texture of which the main orientation component is the {420} plane is formed as a recrystallized texture by the solution heat treatment to be described below. However, it is highly effective for imparting high strength to the copper alloy sheet material to cold roll it after the solution heat treatment. With the increase in the reduction ratio in cold rolling, the rolled texture of which the main orientation component is the {220} plane comes to grow more. The increase in the {220} orientation density results in the reduction in the {420} orientation density; but the reduction ratio may be so controlled as to maintain the expression (1), preferably the expression (1)'. However, when the texture of which the main orientation component is the {220} plane grows too much, the workability of the metal sheet may lower. Therefore, preferably, the crystal orientation satisfies the following expression (2). To the effect that both the "strength" and the "bending workability" of the metal sheet are well balanced and satisfied, more preferably, the crystal orientation satisfies the following expression (2)'.

$$I\{220\}/I_0\{220\} \leqq 3.0 \quad (2)$$

$$0.5 \leqq I\{220\}/I_0\{220\} \leqq 3.0 \quad (2)'$$

In these, I{220} is the X-ray diffraction integral intensity from the {220} crystal plane of the copper alloy sheet material, and $I_0\{220\}$ is the X-ray diffraction integral intensity from the {220} crystal plane of a standard pure copper powder.

As demonstrated in Examples given hereinunder, the sheet material having the specific crystal orientation may have "high strength" peculiar to the alloy. In addition, the crystal orientation is effective for preventing the problems of "thermal deformation" and "spring-back". Further, the sheet material does not require any extreme crystal grain refinement for enhancing the bending workability thereof, and it may fully enjoy the effect of Be added thereto for enhancing the "stress relaxation resistance" thereof.

<<Mean Crystal Grain Size>>

As so mentioned in the above, a smaller mean crystal grain size is advantageous for improving the bending workability but is apt to degrade the stress relaxation resistance when too small. As a result of various investigations, it has been known that a final mean crystal grain size of at least 10 μm, preferably more than 10 μm, is suitable because it facilitates realization of stress relaxation resistance at a level satisfactory even for vehicle-mounted connector applications. More preferably, the size is at least 15 μm. However, an excessively large mean crystal grain size is apt to cause surface roughening at bends of the metal sheet and may degrade the bending workability thereof, so it is preferably made to fall in a range of not larger than 60 μm. More preferably it is at most 40 μm, even more preferably at most 30 μm. The final mean grain size may be determined almost by the crystal grain size in the stage after solution heat treatment. Accordingly, the mean crystal grain size may be controlled by the condition in the solution heat treatment to be mentioned hereinunder.

<<Alloy Composition>>

In the invention, employed is a Cu—Ti-based copper alloy comprising a binary basic ingredients of Cu—Ti and optionally containing some other alloying elements of Fe, Co, Ni, and others.

Ti is an element having a high age-hardening effect in a Cu matrix, and contributes toward increase in strength and toward enhancement of stress relaxation resistance. In the Cu—Ti-based copper alloy, Ti forms a super-saturated solid solution in solution heat treatment; and when the alloy is aged at lower temperatures, then a semi-stable phase of a modulated structure (spinodal structure) grows to give a stable phase ($TiCu_3$) after further aging. The modulated structure differs from precipitates formed in ordinary nucleation and nuclear growth; and not requiring nucleation, the structure is formed through continuous fluctuation of the solute atom concentration, and grows while keeping a complete conformity with the mother phase. During the stage of its growth, the material is greatly hardened and its ductility loss is small. On the other hand, the stable phase ($TiCu_3$) comprises ordinary precipitates spotwise existing in intergranular and intragranular areas, and they readily grow large, and though its hardening effect is smaller than that of the semi-stable phase of modulated structure, its ductility loss is large.

Accordingly, as the means for reinforcing the Cu—Ti-based copper alloy, it is desirable that the strength thereof is enhanced by the semi-stable phase as much as possible and the formation of the stable phase ($TiCu_3$) is inhibited in the alloy. When the Ti content is less than 1.0% by mass, then the alloy could hardly receive the reinforcing effect of the semi-stable phase. On the other hand, when the Ti content is excessive, then the stable phase ($TiCu_3$) may form readily and the temperature range for the solution heat treatment may be narrowed, whereby the alloy could hardly have good properties. As a result of various investigations, Ti content must be at most 5.0% by mass. Accordingly, the Ti content is defined to be from 1.0 to 5.0% by mass. More preferably, the Ti content is controlled to be from 2.0 to 4.0% by mass, even more preferably from 2.5 to 3.5% by mass.

Fe, Co and Ni are elements that form intermetallic compounds with Ti, thereby contributing toward increasing the strength of the alloy. At least one of these elements may be added to the alloy. In particular, in the solution heat treatment of the Cu—Ti-based copper alloy, the intermetallic compounds act to inhibit the crystal grains from growing into coarse grains, therefore enabling solution heat treatment in a higher temperature range, and are advantageous for sufficient solution of Ti in the alloy. However, when Fe, Co and Ni are added too excessively, the amount of Ti to be consumed in forming their intermetallic compounds shall increase naturally. In this case, the strength of the alloy may be rather lowered. Accordingly, when any of Fe, Co and Ni is added, their range is as follows: Fe is at most 0.5% by mass, Co is at most 1.0% by mass and Ni is at most 1.5% by mass. For more sufficiently exhibiting the effect, addition of at least one of those elements within the following range is effective: Fe is from 0.05 to 0.5% by mass, Co is from 0.05 to 1.0% by mass, and Ni is from 0.05 to 1.5% by mass. More preferably, Fe is from 0.1 to 0.3% by mass, Co is from 0.1 to 0.5% by mass, and Ni is from 0.1 to 1.0% by mass.

Sn has a solid solution reinforcing effect and a stress relaxation resistance enhancing effect. For Sn to thoroughly exert such its effects, the Sn content is preferably at least 0.1% by mass. However, when the Sn content is more than 1.0% by mass, then the castability and the conductivity of the alloy may greatly lower. Accordingly, when Sn is added to the alloy, its content must be at most 1.0% by mass. More preferably, the Sn content is controlled to be from 0.1 to 1.0% by mass, still more preferably from 0.1 to 0.5% by mass.

Zn enhances the solderability and the strength of the alloy, and also has an effect of enhancing the castability thereof. Further, when Zn is added to the alloy, its another advantage is that inexpensive brass scrap may be used for the alloy. However, when the Zn content is more than 2.0% by mass, then it may often cause reduction in the conductivity and the stress corrosion cracking resistance. Accordingly, when Zn is added to the alloy, its content is within a range of at most 2.0% by mass. For more sufficiently exhibiting the above effects, Zn is added to the alloy in an amount of at least 0.1% by mass, more preferably in an amount controlled to fall within a range of from 0.3 to 1.0% by mass.

Mg has an effect of enhancing the stress relaxation resistance and an effect of desulfurization. For sufficiently exhibiting these effects, preferably, the Mg content is at least 0.01% by mass. However, Mg is an easily oxidizable element, and when its content is more than 1.0% by mass, then the castability of the alloy may greatly worsen. Accordingly, when Mg is added to the alloy, its content must be at most 1.0% by mass. More preferably, the Mg content is controlled to be from 0.01 to 1.0% by mass, even more preferably from 0.1 to 0.5% by mass.

As other elements that may be added to the alloy, at least one additional element of at most 1.0% of Zr, at most 1.0% of Al, at most 1.0% of Si, at most 0.1% of P, at most 0.05% of B, at most 1.0% of Cr, at most 1.0% of Mn and at most 1.0% of V may be added to the alloy, all by mass. For example, Zr and Al form intermetallic compounds with Ti; and Si may from a precipitate with Ti, Cr, Zr, Mn and V may readily form high-melting-point compounds with inevitable impurities, S and Pb; and Cr, B, P and Zr have an effect of refining the casting texture, therefore contributing toward enhancing the hot workability of the alloy.

In case where at least one of Zr, Al, Si, P, B, Cr, Mn and V is incorporated in the alloy, it is effective that their total amount is controlled to be at least 0.01% by mass. However, when too much, it may have some negative influences on the hot and cold workability of the alloy, and is disadvantageous in point of the cost. Accordingly, the total amount of the above-mentioned Sn, Zn and Mg, and Zr, Al, Si, P, B, Cr, Mn and V is preferably at most 3% by mass, more preferably at most 2% by mass, even more preferably at most 1% by mass. As the case may be, it may be controlled to be within a range of at most 0.5% by mass.

<<Properties>>

In order to cope with the ongoing size and thickness reduction of electrical and electronic parts by the use of the Cu—Ti-based copper alloy, preferably, the alloy sheet material has a tensile strength of at least 800 MPa, more preferably at lest 900 MPa, even more preferably at least 1000 MPa. Applying the production condition to be mentioned hereinunder to the alloy satisfying the above-mentioned chemical composition enables the production of the alloy sheet material satisfying the strength requirement.

Regarding the "ordinary bending workability" (as mentioned in the above), the ratio R/t is preferably at most 1.0, more preferably at most 0.5 in both LD and TD, where R indicates the minimum bending radius of the sheet material not cracking in the 90°-W bending test and t indicates the sheet thickness t thereof. For increasing the shape and dimensional accuracy of bent articles of the alloy sheet, R/t is preferably 0 in point of the "bending workability after notching" to be described hereinunder. This means that the bent articles have no cracks in the method of evaluation of the LD bending workability after notching. The "LD bending workability" is the bending workability evaluated for a bending workability test piece cut so that its long-side direction corresponds to LD (the same shall apply to the being workability after notching); and the bending axis in the test is TD. Similarly, the "TD bending workability" is the bending workability evaluated for a bending workability test piece cut so that its long-side direction corresponds to TD, and the bending axis in the test is LD.

The TD value of the stress relaxation resistance of the alloy sheet material is especially important in vehicle-mounted connectors and the like other applications. Therefore, it is desirable that the stress relaxation is determined based on the stress relaxation rate of a test piece of which the long-side direction corresponds to TD. In the method of evaluating the stress relaxation resistance to be mentioned hereinunder, the stress relaxation rate of the test sample kept at 200° C. for 1000 hours is preferably at most 5%, more preferably at most 3%.

"Spring-back" in bending is an especially important factor of mill-hardened materials. Of the W-bending test pieces having undergone a test for "ordinary bending workability", those having a ratio R/t of not larger than 1.0 (concretely, the test pieces not cracked when having a minimum ending radius R) are analyzed for the actual bending deformation angle, θ (°), at the bend (the center of three) thereof; and the samples having a value, θ-90°, indicating the spring-back thereof, of at most 3° in both LD and TD are considered as good Cu—Ti alloys having extremely excellent "spring-back" resistance. Preferably, the LD test pieces tested for the "bending workability after notching" mentioned hereinunder has the value θ-90° of at most 2°.

<<Production Method>>

The above-mentioned copper alloy sheet of the invention may be produced, for example, according to the following production method:

"Melting/Casting→Hot Rolling→Cold Rolling→Solution Heat Treatment→Finish Cold Rolling→Aging Treatment"

However, it may be necessary to introduce refinements into some of the processes as explained in the following. Although not included in the production processes shown in the above, hot rolling may be followed by optional facing, and heat treatment can be followed by optional acid-washing, polishing or degreasing. The processes will be described below.

[Melting/Casting]

Slabs can be produced by continuous casting, semi-continuous casting or the like. For preventing oxidation of Ti, the process is preferably effected in an inert gas atmosphere or vacuum melting furnace.

[Hot Rolling]

To avoid generation of precipitates in the course of rolling, Cu—Ti-based copper alloy hot rolling is usually conducted by a method of rolling the alloy in a high-temperature range of not lower than 700° C. or not lower than 750° C. followed by quenching it after the rolling. However, the copper alloy sheet material having the unique texture of the invention is difficult to produce under these commonly accepted hot rolling conditions. Specifically, the inventors conducted an investigation in which the inventors varied the conditions in the processes to follow the hot rolling under such conditions over broad ranges but were unable to find out the conditions that enabled the production of a copper alloy sheet material having the {420} plane as its main orientation direction with good reproducibility. The inventors therefore carried out a further thorough study through which the inventors discovered the hot rolling conditions of the present invention, namely, the conditions of conducting the first pass rolling in a temperature range of from 950° C. to 700° C. and then conducting the next rolling in a temperature range of from lower than 700° C. to 500° C. at a reduction ratio of at least 30%.

When the slab is hot-rolled, the first rolling pass in a temperature range above 700° C., in which recrystallization readily occurs, breaks down the cast structure and makes the composition and texture uniform. However, in rolling at a high temperature exceeding 950° C., the temperature range must be so controlled that it does not cause cracking in the portions where the alloying components have segregated and in the other portions where the melting point thereof has dropped. In order to ensure that total recrystallization occurs during the hot rolling process, it is highly effective to conduct the rolling in a temperature range of from 950° C. to 700° C. at a rolling reduction ratio of at least 60%. This helps to make the texture still more uniform. However, a large rolling load is required to achieve a reduction ratio of at least 60% in a single pass and it is acceptable to bring the total reduction ratio up to at least 60% by dividing the rolling process into multiple passes. In the invention, it is also important to achieve a rolling reduction ratio of at least 30% in a temperature range of from lower than 700° C. to 500° C. in which rolling strain readily occurs. The formation of some precipitates in this way and the combination of "cold rolling+solution heat treatment" in the ensuing processes facilitates formation of a recrystallized texture of which the main orientation component is the {420} plane. At this time, too, a number of rolling passes can be conducted in a temperature range of from lower than 700° C. to 500° C. In the temperature range, more preferably, the reduction ratio is at least 40%. It is more effective to conduct the final pass in the hot rolling at a temperature of not higher than 600° C. The total reduction ratio in the hot rolling may be from about 80 to 97%.

The reduction ratio $\epsilon$ (%) in each temperature range is computed according to the expression (3):

$$\epsilon=(t_0-t_1)/t_0\times 100 \quad (3)$$

Assume, for example, that the thickness of the slab subjected to the first rolling pass is 120 mm and this is rolled in a temperature range of not lower than 700° C. (it is acceptable to return the slab to the furnace for reheating it during the rolling), the thickness of the slab at the end of the final rolling pass effected at a temperature of not lower than 700° C. is 30 mm, the rolling is continued with the final hot rolling pass being conducted in a range of from lower than 700° C. to 400° C., and finally a hot-rolled sheet having a thickness of 10 mm is obtained. In this case, the reduction ratio in the rolling conducted in the temperature range of not lower than 700° C., as computed according to the expression (3), is (120−30)/120×100=75(%). The reduction range in the temperature range of from lower than 700° C. to 400° C., as also calculated according to the expression (3), is (30−10)/30×100=66.7(%).

[Cold Rolling]

During rolling of the hot-rolled sheet, it is important that, in the cold rolling to be conducted before the solution heat treatment, the reduction ratio is at least 80%, more preferably at least 90%. By conducting the solution heat treatment of the next step on the sheet processed at such a high reduction ratio, there can be formed a recrystallized texture of which the main orientation component is {420} plane. In particular, the recrystallized texture is highly dependent on the cold rolling reduction ratio before the recrystallization. Concretely, the occurrence of the crystal orientation of which the main orientation component is the {420} plane is substantially nil when the cold rolling reduction ratio is not higher than 60%, but gradually increases with the increase in the reduction ratio in a range of approximately from 60% to 80%, and rises sharply when the cold reduction ratio exceeds about 80%. In order to obtain a crystal orientation strongly dominated by the {420} orientation, it is necessary to ensure a cold reduction ratio of at least 80%, more preferably at least 90%. The upper limit of the cold rolling reduction ratio need not be specially defined because the maximum ratio achievable is automatically determined by the mill power and the like. However, good results are easily to obtain at a reduction ratio of at most around 99%.

In the invention, employable is a process that comprises hot rolling followed by cold rolling to be effected once or plural times before solution heat treatment via intermediate annealing therebetween; however, in the cold rolling just before the solution heat treatment, a reduction ratio of at least 80% must be ensured. When the cold reduction ratio just before the solution heat treatment is lower than 80%, then the recrystallized texture of which the main orientation component is the {420} plane, as formed by the solution heat treatment, would be extremely weak.

[Solution Heat Treatment]

Although conventional solution heat treatment is aimed mainly at "returning solute elements to solid solution in the matrix" and "recrystallization", another important aim in the present invention is to form the recrystallized texture of which the main orientation component is the {420} plane. The solution heat treatment is preferably conducted at a furnace temperature of from 700 to 900° C. When the temperature is too low, then the recrystallization may be incomplete and the entry of the solute elements into solid solution may be insufficient. When the temperature is too high, then the crystal grains may become coarse. In either case, it will be difficult to finally obtain a high-strength material excellent in bending workability.

In the solution heat treatment, the heat treatment is preferably carried out by controlling the retention time and the ultimate temperature in such a manner that the mean grain size of the recrystallized grains (twin boundaries not considered as crystal boundaries) may be from 10 to 60 μm, more preferably from more than 10 μm to 60 μm, even more preferably from 15 to 40 μm in a temperature range of from 700 to 900° C. When the recrystallized grains are too fine, then the recrystallized texture of which the main orientation component is the {420} plane may be weak. Excessively fine recrystallized grains are also disadvantageous from the viewpoint of improving the stress relaxation resistance of the alloy sheet material produced. When the recrystallized grains are too coarse, then surface roughness tends to occur at bends. The size of the recrystallized grains varies depending on the cold rolling reduction ratio before the solution heat treatment and the chemical composition thereof. Nevertheless, the retention time and the ultimate temperature can be so defined that the temperature could be within the range of from 700 to 900° C., based on the results of the experiments conducted for the alloy concerned to determine the relationship between the heating pattern in the solution heat treatment and the mean crystal grain size of the alloy grains. Concretely, in the case of the alloy having the chemical composition defined in the invention, suitable conditions can be set within the heating conditions at a temperature of from 700 to 900° C. for a retention time of from 10 seconds to 10 minutes.

[Finish Cold Rolling]

Next, the alloy metal sheet may be processed for finish cold rolling at a reduction ratio of at most 65%. In this stage, the cold rolling is effective for promoting the precipitation during the subsequent aging treatment, whereby the aging temperature to bring about the necessary properties (conductivity, hardness) may be lowered and the aging time may be shortened. Accordingly, the thermal deformation during the aging process can be thereby reduced.

The final cold rolling develops the texture of which the main orientation component is the {220} plane; however, in a range of a cold reduction ratio of at most 65%, crystal grains of which the {420} plane is parallel to the sheet plane fully exist in the texture. In this stage, the reduction ratio in the finish cold rolling must be at most 65%, preferably from 0 to 50%. When the reduction ratio is too high, the ideal crystal orientation to satisfy the above-mentioned expression (1) is difficult to obtain. When the reduction ratio is zero, this means that the metal sheet is directly subjected to the next aging treatment not via the finish cold rolling after the solution heat treatment. In the invention, the finish cold rolling step may be omitted for increasing the producibility.

[Aging Treatment]

In the aging treatment, the metal sheet material is processed under the condition effective for increasing the conductivity and the strength of the alloy at a temperature not too much elevated. When the aging temperature is too high, then the crystal orientation predominantly grown in the {420} direction in the previous solution heat treatment may be weakened and, as a result, the workability of the sheet material could not be sufficiently improved. Concretely, the treatment is attained preferably at a material temperature falling within a range of from 300 to 550° C., more preferably from 350 to 500° C. The aging treatment time may be within a range of from approximately 60 to 600 minutes. In case where the formation of the surface oxide film is prevented as much as possible during the aging treatment, a hydrogen, nitrogen or argon atmosphere may be used.

However, in the Cu—Ti-based copper alloy, it is important to prevent as much as possible the formation of the above-mentioned stable layer. Effectively for this, the aging temperature in the aging treatment process is defined with a range of from 300 to 550° C. and within a range of $T_M \pm 10°$ C., and the aging time is so defined that the hardness of the aged alloy could be from 0.85 $H_M$ to 0.95 $H_M$, in which $T_M$ (° C.) means the aging temperature at which the alloy composition could have the maximum hardness and $H_M$ (HV) means the maximum hardness. The aging temperature $T_M$ (° C.) to give the maximum hardness, and the maximum hardness $H_M$ (HV) can be determined in preliminary experiments. Having the composition range defined in the invention, in general, the alloy sheet may have a maximum hardness within an aging time of at most 24 hours.

EXAMPLES

Molten copper alloys produced to have the compositions shown in Table 1 were cast using a vertical continuous casting machine. The obtained slabs (thickness: 60 mm) were heated at 950° C., and their hot rolling was started. The pass schedule at this time was, except in some Comparative Examples, established to conduct rolling at a reduction ratio of at least 60% in a temperature range of not lower than 700° C., and also conduct rolling in a temperature range lower than 700° C. Except in some Comparative Examples, the final pass temperature of the hot rolling was between 600° C. and 500° C. The total hot rolling reduction ratio starting from the slab was about 95%. After the hot rolling, the oxidized surface layer was removed by machine polishing (facing). Next, cold rolling was carried out at one of various reduction ratios, whereafter each sample was subjected to solution heat treatment. Except in some Comparative Examples, the mean grain size (twin boundaries not considered as crystal boundaries) after the solution heat treatment was controlled to be from more than 10 μm to 40 μm by controlling the ultimate temperature to fall within a range of from 700 to 900° C. depending on the alloy composition, and the retention time in the temperature range of from 700 to 900° C. was controlled to be within a range of from 10 seconds to 10 minutes. Next, the sheet material after the solution heat treatment was processed for finish cold rolling at one of various reduction ratios of from 0 to 70%. If desired, the samples were machine-polished for facing during the process, and were made to have a controlled thickness of 0.2 mm.

Thus prepared, the sheet materials having a thickness of 0.2 mm were subjected to an aging test for up to at most 24 hours in a temperature range of from 300 to 500° C. as a preliminary experiment, in which the aging treatment condition to give the maximum hardness depending on the alloy composition was determined. (The aging temperature was indicated by $T_M$ (° C.), the aging time was by $t_M$ (min), and the maximum hardness was by $H_M$ (HV).) The aging temperature was defined to fall within a range of $T_M$+10° C., and the aging time was so defined as to be shorter than $t_M$ and as to be able to give a hardness after aging falling within a range of from 0.85 $H_M$ to 0.95 $H_M$. Under the controlled condition, the sheet materials having a thickness of 0.2 mm were aged to prepare samples. In some Comparative Examples, the aging treatment condition was to give the maximum hardness $H_M$.

TABLE 1

| | | Chemical Composition (mas. %) | | | | |
|---|---|---|---|---|---|---|
| Group | No. | Ti | Fe | Co | Ni | Others |
| Examples of the Invention | 1 | 4.61 | — | — | — | Zr: 0.12, P: 0.05 |
| | 2 | 4.08 | 0.18 | — | — | — |
| | 3 | 3.62 | — | 0.26 | — | — |
| | 4 | 3.21 | — | — | — | — |
| | 5 | 2.84 | — | 0.15 | 0.25 | — |
| | 6 | 2.26 | — | — | — | Si: 0.11, Al: 0.18, Zn: 0.36 |
| | 7 | 1.83 | 0.22 | — | — | Sn: 0.13, Mg: 0.10, Mn: 0.04 |
| | 8 | 1.25 | 0.25 | — | 0.12 | Cr: 0.21, V: 0.14, B: 0.03 |
| Comparative Examples | 21 | 4.61 | — | — | — | Zr: 0.12, P: 0.05 |
| | 22 | 4.08 | 0.18 | — | — | — |
| | 23 | 3.62 | — | 0.26 | — | — |
| | 24 | 3.21 | — | — | — | — |
| | 25 | 2.84 | — | 0.15 | 0.25 | — |
| | 26 | 0.80 | 0.15 | — | — | Mg: 0.17 |
| | 27 | 5.41 | — | 0.73 | 0.25 | Zn: 0.25 |
| | 28 | 3.21 | 0.21 | — | — | — |
| | 29 | 3.21 | 0.21 | — | — | — |
| | 30 | 3.21 | 0.21 | — | — | — |
| | 31 | 3.21 | 0.21 | — | — | — |
| | 32 | 3.15 | — | — | — | — |
| | 33 | 3.15 | — | — | — | — |

Underlined: Outside the scope of the invention.

Test pieces were taken from the samples after the aging treatment, and analyzed for the mean crystal grain size, the texture, the conductivity, the tensile strength, the stress relaxation, the ordinary bending workability and the bending workability after notching thereof. The spring-back in bending the test pieces was determined by analyzing them for the shape thereof after the test for ordinary bending workability and the test for bending workability after notching. In Table 1, No. 32 and No. 33 are test pieces of commercially-available Cu—Ti-based copper alloys C199-1/2H and C199-EH (both mill-hardened materials having a thickness of 0.2 mm).

The texture and the properties of the samples were determined according to the methods mentioned below.

[Mean Crystal Grain Size]

The sheet plane of each sample is polished and then etched, and the plane is observed with an optical microscope to determine the mean crystal grain size according to the cutting method of JIS H0501.

[Texture]

The sheet plane (rolled plane) of each sample is polished and finished with a waterproof paper abrasive #1500 to prepare a test piece. Using an X-ray diffractiometer (XRD), the polished and finished plane is analyzed for the reflective diffraction integral intensity from the {420} and the {220} plane, under the condition of an Mo—Kα ray, a bulb voltage of 20 kV and a bulb current of 2 mA. On the other hand, using the same X-ray diffractiometer under the same condition as above, a standard pure copper powder is analyzed for the X-ray diffraction integral intensity from the {420} and the {220} plane. Based on these data, the X-ray diffraction integral intensity ratio, $I\{420\}/I_0(420\}$ in the above expression (1), and the X-ray diffraction integral intensity ratio, $I\{220\}/I_0(220\}$ in the above expression (2) are computed.

[Conductivity]

The conductivity of each sample is determined according to JIS H0505.

[Tensile Strength]

LD tensile strength test pieces (JIS No. 5) are taken from each test specimen, and tested for their tensile strength according to a tensile strength test method of JIS Z2241 with n=3. The data of the samples, n=3 are averaged.

[Stress Relation]

A bending test piece (width: 10 mm) is taken from each test specimen so that its long-side direction corresponds to TD, and fastened to have an arch-like bend such that the magnitude of the surface stress of the middle portion in the long-side direction of the test piece may be 80% of the 0.2% yield strength thereof. The surface stress is defined by the equation:

$$\text{Surface stress (MPa)}=6Et\delta/L_0^2,$$

where

E: elastic modulus (MPa), t: test piece thickness (mm),

δ: test piece flex height (mm).

After the test piece is held in this condition for 1000 hours in a 200° C. atmosphere, the stress relaxation is computed from the wrap, using the following equation:

$$\text{Stress relaxation rate (\%)}=(L_1-L_2)/(L_1-L_0)\times 100,$$

where $L_0$: tool length, i.e., horizontal distance (mm) between the ends of the fastened test piece during the test, $L_1$: test piece length (mm) at the start of the test, $L_2$: horizontal distance (mm) between the ends of the test piece after the test.

Samples having a stress relaxation rate of at most 5% are good, as having high durability enough for vehicle-mounted connectors.

[Ordinary Bending Workability]

LD bending test pieces and TD bending test pieces (each 10 mm in width) are taken from each test specimen so that their long-side directions correspond to LD and TD, respectively, and are tested in the 90°-W bending test according to JIS H3110. The surfaces and the cross sections at the bends of the test pieces after the test are observed with an optical microscope at a magnification of 100-power to determine the minimum bending radius, R, of the test piece not cracking in the test. This is divided by the thickness, t, of the test piece to give R/t in LD and TD. Both in LD and in TD, n=3, and the data of the test piece having the worst result of n=3 is employed to compute and express the ratio R/t.

[Bending Workability after Notching]

Figure 2:
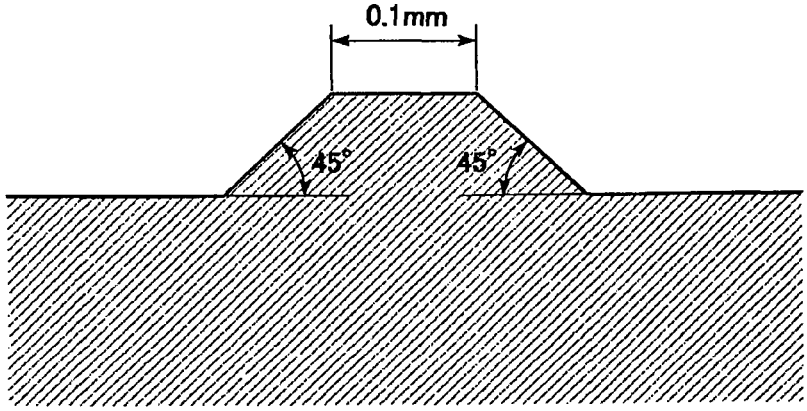
FIG. 2 shows a cross-sectional profile of a notching tool.
Figure 3:
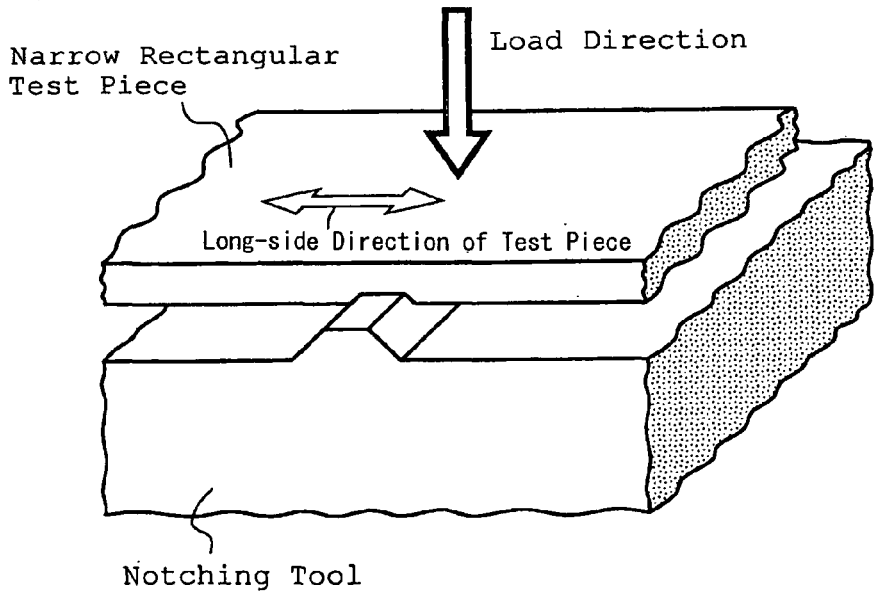
FIG. 3 is a schematic view of a notching method.
Figure 4:
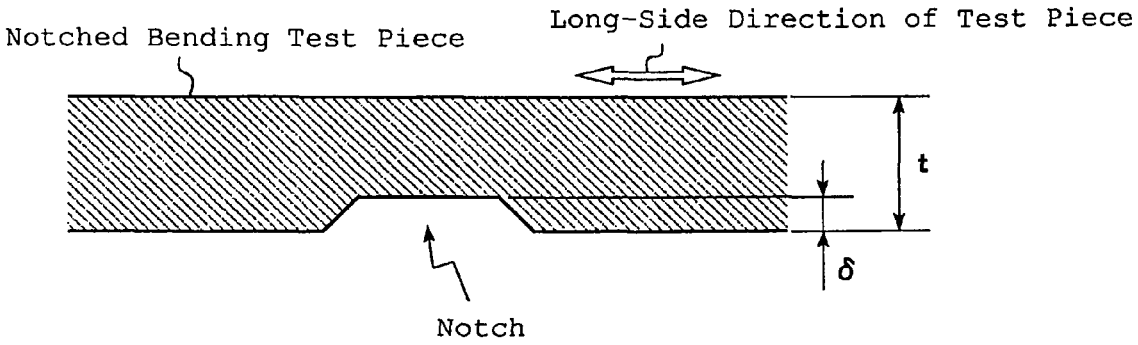
FIG. 4 is a schematic view showing a cross section around the notched region of a notched bending-test-piece.

A narrow rectangular test piece (width: 10 mm) taken from each test specimen so that its long-side direction corresponds to LD is notched to the full width thereof, using a notching tool having a cross-sectional profile shown in FIG. 2 (width of the flat face at the tip of protrusion: 0.1 mm, angle at both sides: 45°) and applying a load of 20 kN thereto as shown in FIG. 3. The notch direction (i.e., the direction parallel to the groove) is perpendicular to the long-side direction of the test piece. The depth of the notch of the thus-prepared, notched bending-test-piece is measured; and the notch depth δ, as illustrated schematically in FIG. 4, is from about ¼ to ⅙ of the thickness, t.

The notched bending-test-piece is tested according to the 90°-W bending test of JIS H3110. In this test, a tool is used in which R of the center protrusion tip of the lower die is 0 mm. The 90°-W bending test is carried out with the notched bending-test-piece placed with its notched surface facing downward and set so that the center protrusion tip thereof may align with the notch.

The surface and the cross section at the bend of the test piece after thus tested are observed with an optical microscope at a magnification of 100-power to check for cracking. A rating of G (good) is assigned to the samples having no crack, and a rating of P (poor) is assigned to the samples having cracks. The samples broken at the bend are indicated by R (rupture). The number of the samples tested in each test is 3, n=3. The rating G, P and R are based on the data of the test piece having the worst result of n=3. The samples rated G are good and acceptable samples.

[Spring-Back]

Figure 5:
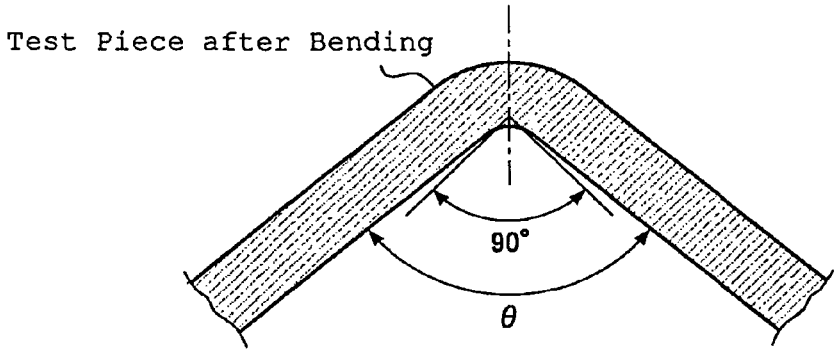
FIG. 5 is a schematic view showing a cross section vertical to the bending axis around the bend (the center of three) of a 90°-W bent test piece.

Of the samples tested for bending at the minimum bending radius thereof according to the "ordinary bend method" and the samples not cracked in the test for bending according to the "notch-and-bend method", the cross section vertical to the bending axis of the bend (the center of three) thereof is observed with an optical microscope-bearing digital microscope (KEYENCE's VH-8000 Model) at a magnification of 150-power, thereby determining the bending angle θ. FIG. 5 is a schematic view showing the cross section vertical to the bending axis near to the bend (the center of three) of a test piece tested in a 90°-W bending test. Of the sample having undergone spring-back, the bending angle θ is larger than 90° (in FIG. 5, θ is exaggerated over its actual one for schematically showing it). The difference between the actual bending angle θ and 90° of the mold (W-bending toll) indicates the spring-back. Specifically, the value of [actual bending angle θ]-90° is determined for each sample, n=3; and the data are averaged to give the spring-back value.

The results are shown in Table 2. In Table 2, LD and TD each mean the long-side direction of the test piece.

TABLE 2

| Group | No. | Production Condition: Reduction Ratio in hot rolling at from lower than 700° C. to 500° C. (%) | Production Condition: Cold Rolling Reduction Ratio: Before Solution Heat Treatment (%) | Production Condition: Cold Rolling Reduction Ratio: Finish Cold Rolling (%) | Production Condition: Aging Treatment Hardness after Aging/Maximum Hardness $H_M$ | Texture: Mean Crystal Grain Size (μm) | Texture: X-Ray Diffraction Integral Intensity Ratio in Formula (1) $I\{420\}/I_0\{420\}$ | Texture: X-Ray Diffraction Integral Intensity Ratio in Formula (2) $I\{220\}/I_0\{220\}$ |
|---|---|---|---|---|---|---|---|---|
| Examples of the Invention | 1 | 40 | 88 | 10 | 0.88 | 20 | 3.0 | 1.5 |
| | 2 | 45 | 92 | 0 | 0.90 | 25 | 3.2 | 1.3 |
| | 3 | 45 | 86 | 15 | 0.90 | 16 | 2.5 | 1.7 |
| | 4 | 50 | 92 | 20 | 0.93 | 22 | 2.2 | 2.1 |
| | 5 | 50 | 90 | 25 | 0.94 | 18 | 2.0 | 1.9 |
| | 6 | 57 | 89 | 35 | 0.95 | 15 | 1.8 | 2.0 |
| | 7 | 50 | 92 | 45 | 0.95 | 16 | 1.8 | 2.5 |
| | 8 | 45 | 92 | 50 | 0.95 | 20 | 1.6 | 2.8 |
| Comparative Examples | 21 | 50 | 92 (*1) | 10 | 0.88 | 18 | 0.5 | 3.1 |
| | 22 | 45 | 35 | 0 | 0.90 | 27 | 0.3 | 2.2 |
| | 23 | 0 (*2) | 40 | 15 | 0.95 | 18 | 0.2 | 2.1 |
| | 24 | 0 (*2) | 92 | 20 | 0.95 | 5 | 0.7 | 3.4 |
| | 25 | 15 | 30 | 25 | 1.00 | 3 | 0.3 | 3.3 |
| | 26 | 50 | 96 | 50 | 0.95 | 18 | 0.8 | 3.3 |
| | 27 | — | — | — | — | — | — | — |
| | 28 | 50 | 85 | 20 | 0.93 | 82 | 1.8 | 2.4 |
| | 29 | 50 | 85 | 20 | 0.93 | mixed grains | 0.4 | 5.1 |
| | 30 | 50 | 85 | 20 | 1.00 | 22 | 2.2 | 2.2 |
| | 31 | 50 | 85 | 70 | 0.93 | 22 | 0.9 | 3.8 |
| | 32 | | (commercial product) | | | 7 | 0.5 | 3.3 |
| | 33 | | (commercial product) | | | 7 | 0.3 | 3.9 |

| Group | No. | Bending Workability: Ordinary Bending Workability (R/t) LD | Bending Workability: Ordinary Bending Workability (R/t) TD | Bending Workability: Bending Workability after notching (evaluation) LD | Spring-Back in Bending (°): Ordinary Bending LD | Spring-Back in Bending (°): Bending after notching TD | Spring-Back in Bending (°): Bending after notching LD | Conductivity (% IACS) | Tensile Strength LD (MPa) | Stress Relaxation LD (%) |
|---|---|---|---|---|---|---|---|---|---|---|
| Examples of the Invention | 1 | 0.0 | 1.0 | G | 2.3 | 3.5 | 1.7 | 10.2 | 1015 | 2.7 |
| | 2 | 0.0 | 0.0 | G | 1.8 | 2.0 | 1.2 | 11.2 | 860 | 2.6 |
| | 3 | 0.0 | 0.5 | G | 2.1 | 3.3 | 1.6 | 12.6 | 946 | 2.8 |
| | 4 | 0.0 | 0.5 | G | 1.7 | 2.4 | 0.8 | 13.2 | 916 | 3.2 |
| | 5 | 0.0 | 0.3 | G | 1.5 | 2.1 | 0.8 | 13.6 | 880 | 3.4 |
| | 6 | 0.0 | 0.0 | G | 1.4 | 1.8 | 0.5 | 14.4 | 865 | 3.5 |
| | 7 | 0.0 | 0.0 | G | 1.0 | 1.5 | 0.3 | 15.2 | 828 | 3.3 |
| | 8 | 0.0 | 0.0 | G | 1.2 | 1.5 | 0.5 | 16.6 | 825 | 3.4 |
| Comparative Examples | 21 | 2.0 | 3.0 | R | 6.5 | 7.2 | — | 10.3 | 1010 | 3.6 |
| | 22 | 2.0 | 3.0 | R | 6.4 | 6.8 | — | 11.7 | 866 | 3.9 |
| | 23 | 2.0 | 2.5 | P | 6.0 | 6.4 | — | 12.7 | 963 | 4.2 |
| | 24 | 1.5 | 2.5 | P | 3.8 | 6.5 | — | 13.6 | 928 | 5.4 |
| | 25 | 3.0 | 5.0 | R | 7.7 | 9.5 | — | 14.1 | 926 | 7.5 |
| | 26 | 1.0 | 2.5 | P | 2.8 | 6.2 | — | 34.5 | 652 | 9.4 |
| | 27 | — | — | — | — | — | — | — | — | — |
| | 28 | 2.0 | 2.5 | P | 5.7 | 6.4 | — | 12.6 | 908 | 2.2 |
| | 29 | 3.0 | 4.0 | R | 7.0 | 9.2 | — | 15.3 | 726 | 9.6 |
| | 30 | 1.0 | 1.5 | P | 3.2 | 3.7 | — | 13.4 | 967 | 5.2 |
| | 31 | 1.5 | R | P | 3.2 | — | — | 11.4 | 1074 | 4.4 |
| | 32 | 1.5 | 2.0 | P | 5.3 | 6.1 | — | 13.1 | 846 | 5.8 |
| | 33 | 2.0 | 4.0 | R | 5.2 | 8.2 | — | 12.4 | 958 | 6.2 |

Underlined: Outside the scope of the invention.

(*1) Intermediate annealing at 600° C. × 3 hours was carried out in the middle of cold rolling of 92% in total.

(*2) The hot rolling end temperature was not lower than 700° C.

As known from Table 2, the copper alloy sheets of Examples of the invention all have a crystal orientation satisfying the expression (1) and a tensile strength of at least 800 MPa and have excellent bending workability in that the ratio R/t thereof is at most 1.0 both in LD and TD. Regarding the LD bending workability after notching thereof that is important in practical use, the samples of the invention do not crack even in severe bending at R/t=0 in the 90°-W bending test. In addition, they have excellent stress relaxation resistance in that the spring-back thereof in working is small and the TD stress relaxation thereof, which is an important factor for vehicle-mounted connectors and others, is at most 5%.

On the other hand, Comparative Examples 21 to 25 are alloys having the same composition as that of Examples 1 to 5, respectively, of the invention, but they were produced according to ordinary methods (the final pass temperature in hot rolling is not lower than 700° C.; or intermediate annealing is effected after hot rolling and before solution heat treatment; or the cold rolling reduction ratio before solution heat treatment is less than 80%). These are all poor in that the X-ray diffraction intensity from the {420} crystal plane thereof is weak, and they have tradeoffs between the strength and the bending workability, or between the bending workability and the stress relaxation resistance. In particular, they could not be worked for bending after notching, and therefore their minimum bending radius must be enlarged and their spring-back is large.

In Comparative Examples 26 and 27, the Ti content is outside the scope of the invention, and therefore the samples do not have good properties. Precisely, the Ti content in No. 26 is too low, and the amount of the precipitates formed is small; and therefore, even though the alloy is aged under the condition to give a maximum hardness, its strength level is low. Even when the cold rolling reduction ratio before the solution heat treatment is increased up to at least 95%, the crystal orientation of which the main orientation component is the {420} plane of the sample is weak, and the strength level thereof is low, and the bending workability thereof after notching could not be improved. In No. 27, the Ti-content is too high, and the sample could not meet a suitable condition for solution heat treatment, and as a result, the sample is cracked during its production, therefore not giving a sheet material enough for evaluation.

In Comparative Examples 28 to 30, the condition for solution heat treatment and the condition for aging are outside the scope of the invention, and therefore the samples could not have good properties. In No. 28, the temperature for solution heat treatment is 970° C. and is too high, and therefore the crystal grains grow coarse and the alloy sample could not have good bending workability. On the contrary, in No. 29, the temperature for solution heat treatment is 650° C. and is too low, and therefore, the recrystallization is insufficient and a mixed grain texture is formed. In this, the alloy is poor in point of all the tensile strength, the bending workability and the stress relaxation resistance. In No. 30, the time for aging treatment is so controlled that the aged alloy could have a maximum hardness. In this case, the sample may have an increased tensile strength of about 50 MPa, but it has a stable phase ($TiCu_3$) formed therein and therefore its bending workability and stress relaxation resistance are poor.

In Comparative Example 31, the finish rolling reduction ratio is over the defined range, and therefore the crystal orientation of which the main orientation component is the {420} plane is weak; and accordingly, though the strength of the alloy is high, the bending workability thereof is extremely poor.

Comparative Examples 32 and 33 are typical commercial products of Cu—Ti-based copper alloys, C199-1/2H and 199-ER. In these, the crystal orientation of which the main orientation component is the {420} plane is weak, and as compared with the sample of Example 4 of the invention having nearly the same composition, the bending workability and the stress relaxation resistance of these comparative samples are not good.

What is claimed is:

1. A copper alloy sheet material having a composition that contains, by mass, from 1.0 to 5.0% of Ti with the balance of Cu and inevitable impurities, having a crystal orientation that satisfies the following expression (1), and having a mean crystal grain size of from 10 to 60 μm:

$$I\{420\}/I_0\{420\}>1.0 \quad (1),$$

wherein I{420} is the X-ray diffraction integral intensity from the {420} crystal plane of the copper alloy sheet material, and $I_0\{420\}$ is the X-ray diffraction integral intensity from the {420} crystal plane of a standard pure copper powder.

2. The copper alloy sheet material according to claim 1, which further contains at least one of at most 0.5% of Fe, at most 1.0% of Co and at most 1.5% of Ni.

3. The copper alloy sheet material according to claim 1, which further contains at least one of at most 1.2% of Sn, at most 2.0% of Zn, at most 1.0% of Mg, at most 1.0% of Zr, at most 1.0% of Al, at most 1.0% of Si, at most 0.1% of P, at most 0.05% of B, at most 1.0% of Cr, at most 1.0% of Mn and at most 1.0% of V, in an amount of at most 3% by mass in total.

4. The copper alloy sheet material according to claim 1, of which the crystal orientation further satisfies the following expression (2):

$$I\{220\}/I_0\{220\}<3.0 \quad (2)$$

wherein I{220} is the X-ray diffraction integral intensity from the {220} crystal plane of the copper alloy sheet material, and $I_0\{220\}$ is the X-ray diffraction integral intensity from the {220} crystal plane of a standard pure copper powder.

5. The copper alloy sheet material according to claim 1, which satisfies the bending workability of such that the tensile strength thereof in LD (rolling direction) is at least 800 MPa, the ratio R/t is at most 1.0 in both LD and TD (direction perpendicular to the rolling direction and to the sheet thickness direction) where R means the minimum bending radius of the sheet material not cracking in a 90°-W bending test of JIS H3110 and t means the sheet thickness t, and a value θ-90° indicating the spring-back of the sheet material is at most 3° in both LD and TD where θ(°) indicates the actual bending deformation angle of the bend (a center of three) of the bending test piece of the sheet material giving the value R/t.

6. A method for producing a copper alloy sheet of claim 1, which comprises steps of hot rolling at 950 to 500° C., cold rolling at a reduction ratio of at least 80%, solution heat treatment at 700 to 900° C., finish cold rolling at a reduction ratio of from 0 to 65% and aging treatment at 300 to 550° C. in that order, wherein in the hot rolling step, the first rolling pass is effected in a temperature range of from 950° C. to 700° C., then the rolling is effected in a temperature range of from lower than 700° C. to 500° C. at a reduction ratio of at least 30%.

7. The method for producing a copper alloy sheet according to claim 6, wherein in the hot-rolling step, the reduction ratio is at least 60% in a temperature range of from 950° C. to 700° C.

8. The method for producing a copper alloy sheet according to claim 6, wherein in the solution heat treatment step, the retention time in a range of from 700 to 900° C. and an ultimate temperature are so set in the heat treatment that the mean crystal grain size after the solution heat treatment is from 10 to 60 μm.

9. The method for producing a copper alloy sheet according to claim 6, wherein the aging temperature is within a range of from 300 to 550° C. and is a temperature of $T_M$±10° C. and the aging time is so defined that the hardness after the aging falls within a range of from 0.85 $H_M$ to 0.95 $H_M$ and wherein $T_M$(° C.) means the aging temperature at which the maximum hardness can be obtained with the composition and $H_M$ (HV) means the maximum hardness.

* * * * *